US009847204B2

(12) United States Patent
Bruchmann

(10) Patent No.: US 9,847,204 B2
(45) Date of Patent: Dec. 19, 2017

(54) MULTI-POLE SWITCH-FUSED ARRANGEMENT FOR BUSBAR SYSTEMS

(71) Applicant: Klaus Bruchmann GmbH, Weisskirchen an der Traun (AT)

(72) Inventor: Klaus Bruchmann, Coburg (DE)

(73) Assignee: Klaus Bruchmann GmbH, Weisskirchen an der Traun (AT)

( * ) Notice: Subject to any disclaimer, the term of this patent is extended or adjusted under 35 U.S.C. 154(b) by 0 days.

(21) Appl. No.: 14/926,199

(22) Filed: Oct. 29, 2015

(65) Prior Publication Data

US 2016/0126047 A1 May 5, 2016

(30) Foreign Application Priority Data

Oct. 31, 2014 (EP) ..... 14191237

(51) Int. Cl.
*H01H 85/055* (2006.01)
*H01H 85/143* (2006.01)
(Continued)

(52) U.S. Cl.
CPC ..... *H01H 85/055* (2013.01); *H01H 9/102* (2013.01); *H01H 9/104* (2013.01);
(Continued)

(58) Field of Classification Search
CPC .... H01H 85/055; H01H 85/202; H01H 9/104; H01H 19/635; H01H 9/102; H01H 85/143; H01H 2221/016; H01H 21/165; H01H 31/122; H01H 31/125; H01H 85/22; H01H 85/54; H01H 85/547; H01H 85/56; H01H 85/58; H01H 85/60; H01H 2085/0233;
(Continued)

(56) References Cited

U.S. PATENT DOCUMENTS 6,864,443 B1 * 3/2005 Bruchmann ..... H01H 19/635 200/43.11
2007/0188291 A1 * 8/2007 Buettner ..... H01H 85/205 337/190
(Continued)

FOREIGN PATENT DOCUMENTS

DE 4435828 C1 * 4/1996 ..... H01H 9/102
EP 1906419 A1 4/2008
WO 0111642 A1 2/2001

OTHER PUBLICATIONS

Buettner, Alex, Switchable-type multipole fuse block for bus=bar systems, Apr. 25, 1996, Entire Document (Translation of DE 4435828—attached).*

*Primary Examiner* — Anatoly Vortman
*Assistant Examiner* — Stephen Sul
(74) *Attorney, Agent, or Firm* — Wood, Phillips, Katz, Clark & Mortimer

(57) ABSTRACT

The present invention relates to a multi-pole fused switch arrangement for busbar systems, with at least two fused switch units, each of which can accommodate a fuse. The fused switch arrangement includes a fuse holder per fused switch unit, a fuse driver unit and a switching lever, wherein the fused switch unit is designed such that it enables the insertion and replacement of fuses in a particularly advantageous manner, and furthermore brings the fuses into their contact position in a particularly advantageous manner.

16 Claims, 9 Drawing Sheets

(51) Int. Cl.
*H01H 9/10* (2006.01)
*H01H 19/635* (2006.01)
*H01H 85/20* (2006.01)

(52) U.S. Cl.
CPC ..... *H01H 19/635* (2013.01); *H01H 85/143* (2013.01); *H01H 85/202* (2013.01); *H01H 2221/016* (2013.01)

(58) Field of Classification Search
CPC ..... H01H 9/0207; H01H 9/22; H01H 2071/1036; H02H 3/253; H02H 3/165; H02H 3/13
USPC ..... 337/168, 7, 45, 46, 146, 11, 186, 191, 337/142, 145; 200/49, 50.07, 50.02
See application file for complete search history.

(56) References Cited

U.S. PATENT DOCUMENTS

| | | | | |
|---|---|---|---|---|
| 2013/0023156 | A1* | 1/2013 | von zur Muehlen | H01H 85/202 439/620.26 |
| 2014/0166450 | A1* | 6/2014 | Buettner ..... | H01H 3/02 200/17 R |

* cited by examiner

MULTI-POLE SWITCH-FUSED ARRANGEMENT FOR BUSBAR SYSTEMS

FIELD OF INVENTION

The present invention relates to a multi-pole fused switch arrangement for busbar systems, with at least two fused switch units, each of which can accommodate a fuse, wherein the fused switch arrangement comprises a contact device for busbars.

BACKGROUND OF THE INVENTION

Such fused switch arrangements are in particular deployed for the protection of alternating current circuits, wherein in particular 3-pole fused switch arrangements are used.

Such a fused switch arrangement is, for example, of known art from EP 2 584 577 B1.

Although the fused switch arrangements in the known prior art already make possible some elements promoting security, and operation that is to a large extent convenient and safe, the need exists for further improved fused switch arrangements, which in particular enable an improvement of operability and fulfil high safety requirements, but at the same time operate very reliably, have a long service life and are designed such that operating errors can be avoided as far as possible.

BRIEF SUMMARY OF THE INVENTION

This task is achieved by means of a multi-pole fused switch arrangement in accordance with the disclosure herein.

In accordance with the invention the fused switch arrangement comprises at least two fused switch units, each of which can accommodate a fuse, and a contact device, preferably a contact and mounting device, for busbars. The inventive fused switch arrangement comprises, per fused switch unit, a fuse holder in each case for purposes of accommodating a fuse, wherein the fuse holder is designed such that it can be switched backwards and forwards between a reception position and an operating position. Here the fuse holder is designed such that a fuse (sometimes also called a fuse link) can be inserted into a fuse holder if the fuse holder is located in its reception position. Fuses of an essentially cylindrical shape are typically used as fuses.

The fused switch arrangement furthermore comprises a fuse driver unit, which, per fused switch unit, comprises a fuse driver in each case, wherein the fuse driver unit is designed such that it can be switched backwards and forwards between a reception position and an operating position.

The fused switch arrangement furthermore comprises a switching lever, which is designed such that it can be switched backwards and forwards between a switched-on and a switched-off position, wherein the switching lever is coupled with the fuse driver unit such that the fuse driver unit is located in its reception position if the switching lever is located in its switched-off position, and the fuse driver unit is located in its operating position if the switching lever is located in its switched-on position.

Here the fuse driver unit and the fuse driver are designed and coupled with the switching lever such that the fuse driver fuses, which are inserted in a fuse holder, which is located in its operating position, move relative to the fuse holder from a stand-by position into a contact position, if the switching lever is switched from its switched-off position into its switched-on position.

If the fuses are located in their stand-by position, they are preferably located essentially completely within a region that is defined by the outer boundaries of the fuse holder. If the fuses are moved relative to the fuse holder from a stand-by position into a contact position, the fuses are preferably moved at least partially out of the fuse holder; in a particularly preferred form of embodiment the fuses, when they are in their contact position, are located essentially completely outside the boundaries of the fuse holder.

Such a configuration of a multi-pole fused switch arrangement has various advantages: Firstly a particularly simple mode of operation is possible, since a fuse holder is provided for each fuse; in its reception position it is positioned such that the user can easily insert a fuse (also called a fuse link), preferably a fusible fuse, and preferably a fuse that is essentially cylindrical in shape. Here, while the fuse holder is movable, in normal operation it is preferably always connected with the fused switch arrangement, for example with a housing of the fused switch arrangement, so that the fuse holder cannot be lost.

The fuse holder is thereby typically pushed out of the housing, such that not only is a convenient insertion of the fuse possible, but also an insertion without risk, because the reception region of the fuse holder is arranged outside the housing, and at a considerable distance from other contact points of the fused switch arrangement, when it is located in the reception position. Afterwards the fuse holder with the fuse inserted can conveniently be brought into its operating position.

A special feature of the inventive fused switch arrangement lies in particular in the fact that with the switching-on of the fused switch arrangement, which occurs by means of a movement of the switching lever from its switched-off position into its switched-on position, the fuse is moved into a contact position, but the fuse holder itself is not moved. If, therefore, the switching lever is switched from its switched-off position into its switched-on position, the fuse is moved relative to its fuse holder from a stand-by position into a contact position. This has the advantage that the movement of the fuse into its contact position can occur simply within the housing of the fused switch arrangement, in particular, the fuse holder is not moved, so that the fuse holder, and in particular the parts that are accessible to the user from the external environment, are not moved. The "integrity" of the housing of the fused switch arrangement therefore remains unaltered independently of any switching of the switching lever, so that it is also possible to integrate the fuse holder flawlessly in the fused switch arrangement if it is located in its operating position, since the fuse holder subsequently does not have to be moved any further relative to other parts of the fused switch arrangement, in particular it does not have to be moved relative to the housing of the fused switch arrangement, if the switching lever is moved into the switched-on position.

In this manner it is also made possible that during the switching-on of the fused switch arrangement by means of the switching lever as few parts as possible must be moved, in particular, only parts inside a housing of the fused switch arrangement must be moved.

A further advantage is that the fuse contact can be used directly as a switching contact, since no separate interruption by means of an additional switching contact is required.

The multi-pole fused switch arrangement in accordance with the invention thus optimises both the operational procedures for purposes of inserting or extracting a fuse, and also the switching-on procedure itself, and separates in a particularly advantageous manner the movement of the elements that are required during the insertion or exchange of a fuse, namely the movement of the fuse holder, from the actual switching-on procedure in which, in addition to the switching lever and the fuse driver unit, preferably provided exclusively within the housing, only the fuse itself is moved into its contact position. The fuse holder that is to be directly operated by the user can thereby remain in its position, namely in the operating position.

A particular advantage is furthermore the fact that the fuse holder, which is actuated by the users and therefore, in particular as a result of hasty or not totally correct operation, becomes worn over a long period of use, so that positioning is possibly no longer as exact; during a simple switching-on procedure, that is to say, during a movement of the switching lever into its switched-on position, positioning no longer plays a role, so that any wear phenomena of the fuse holder that may occur no longer play any part in the important switching-on procedure.

In accordance with a particular form of embodiment the fused switch arrangement is designed such that the switching lever can only be moved from its switched-off position into its switched-on position if all the fuse holders are located in their operating positions. This ensures that operating errors can be avoided, so that on the one hand a smooth and safe operation is ensured, and on the other hand any possible hazards, also as a result of damage to the fused switch arrangement or parts of the same, can be avoided.

Each fuse driver preferably comprises a first blocking element, and each fuse holder a second blocking element; these interact with one another such that the first blocking element impacts against the second blocking element or a part thereof, or strikes against the latter, or is prevented in its movement, that is to say, any further movement, such that a switching of the fuse driver unit from its reception position into its operating position is prevented, if just one fuse holder is not located in its operating position.

One of the blocking elements, preferably the first blocking element, preferably comprises a nose, or a projection, or a similar element, while the other of the blocking elements, preferably the second blocking element, comprises a stop or an edge, or a similar element, and a guide element, that is to say, a guide device, or a plurality of elements that form a guide, wherein the said blocking elements are designed and arranged such that the nose, or the projection, or a similar element of the one blocking element can only be introduced into the guide device of the other blocking element if the fuse holder is located in its operating position. Also by this means it is ensured that any operating error is avoided in a particularly simple and reliable manner, wherein at the same time the costs for the implementation of this function are held low.

In accordance with a particularly preferred form of embodiment the fused switch arrangement is designed such that the fuse holder can only be switched from its operating position into its reception position if the switching lever is located in its switched-off position. By this means an increase in operational reliability is also ensured, and any possible operating errors are prevented.

In accordance with a particularly preferred form of embodiment a third and a fourth blocking element are provided for this purpose; these interact with one another in a similar manner to that described in the context of the first and the second blocking elements, so that, in particular with regard to the more detailed implementations of the third and fourth blocking elements, reference is made to the embodiment of the first and second blocking elements.

Needless to say, the particular forms and configurations of the third and fourth blocking elements can be very similar to those of the first and second blocking elements; however, the forms and configurations can also deviate from those of the latter.

In accordance with a particularly preferred form of embodiment the fused switch arrangement is designed such that the switching lever is designed to be bi-stable, that is to say, it is pre-loaded into its two end positions, the switched-off position and the switched-on position.

This is preferably implemented by means of a spring device, which applies a force onto the switching lever, either directly or indirectly, such that the latter is pre-loaded into its switched-on position, and also into its switched-off position This has the advantage that the switching procedure, both from the switched-on position into the switched-off position, and also from the switched-off position into the switched-on position, is indeed initiated by the user, but as soon as the switching lever is guided over a dead point, the further switching procedure is automatically executed by means of the spring force, so that the switching procedure itself, at least at its critical points, is to a large extent independent of the force and the speed with which the user operates the switching lever.

In a particular form of embodiment the fused switch arrangement also comprises a cam element, to which a force is applied by the spring device, and is designed and positioned such that the above-mentioned central position or "dead position" of the switching lever is established, preferably approximately in a central region between the switched-on position and the switched-off position of the switching lever, wherein the switching lever, if it is located outside this "dead position", is pushed by the force of the spring device, and by the transfer action of the cam element, automatically into either its switched-on position or its switched-off position, depending upon which side of the "dead position" of the switching lever it is located.

The cam element can interact either directly or indirectly with a part of the switching lever; in an alternative form of embodiment it is, however, also possible for the cam element to interact directly or indirectly with a part of the fuse driver unit, in particular with a switching bar of the fuse driver unit.

The fuse driver unit is preferably designed as one piece, wherein the fuse drivers are connected with one another by means of at least one switching bar. This has the advantage that this significant unit for the switching-on procedure is compact and operates reliably, wherein, in particular, the possibility that only one fuse driver, and more particularly one fuse, is guided into the contact position, for example accidentally, for example as a result of a fracture of a connecting element, is avoided.

The switching lever is preferably coupled by means of a transfer lever with the fuse driver unit, here the transfer lever is particularly preferably attached to the fuse driver that is located closest to the switching lever so as to enable a coupling that is as simple as possible and to minimise forces, in particular torque forces, which can occur during the switching procedure.

In a preferred form of embodiment the fuse holders are also designed such that they lock into their operating position; in a particularly preferred form of embodiment a spring device is also provided such that the fuse holders can be pushed by the user into the operating position particularly easily, and will reliably remain there.

In a particular form of embodiment of the fused switch arrangement the latter is designed such that it has a longitudinal axis, which extends through the fuse holders arranged one behind another in the longitudinal direction, wherein the fused switch arrangement has a terminal block at each longitudinal end for purposes of connecting contact cables. This has the advantage that the fused switch arrangement can be kept very compact and narrow; furthermore connections are provided at each end of the fused switch arrangement (in the longitudinal direction), which enables simple accessibility.

The electrical lines in the fused switch arrangement are preferably insulated, such that no further insulation elements are required, which also makes possible a compact fused switch arrangement.

The fused switch arrangement preferably comprises an integrated circuit for purposes of controlling the fused switch arrangement, a bus for the onward transmission of measured data, a display for purposes of displaying measured data or operating states, together with operating buttons or operating elements for purposes of operating the fused switch arrangement.

Furthermore, such a fused switch arrangement preferably comprises electronic measuring coils, which, for example, serve to evaluate the operating states and can pass on their measured data, for example, to the integrated circuit, such that the latter processes the measured data, wherein the corresponding results and/or items of information are preferably displayed on the display.

BRIEF DESCRIPTION OF THE DRAWINGS

These and other features of the inventive fused switch arrangement are clarified further with the aid of the following figures, which show particularly advantageous forms of embodiment of the fused switch arrangement. Here.

DETAILED DESCRIPTION OF THE PREFERRED EMBODIMENTS

Figure 1:
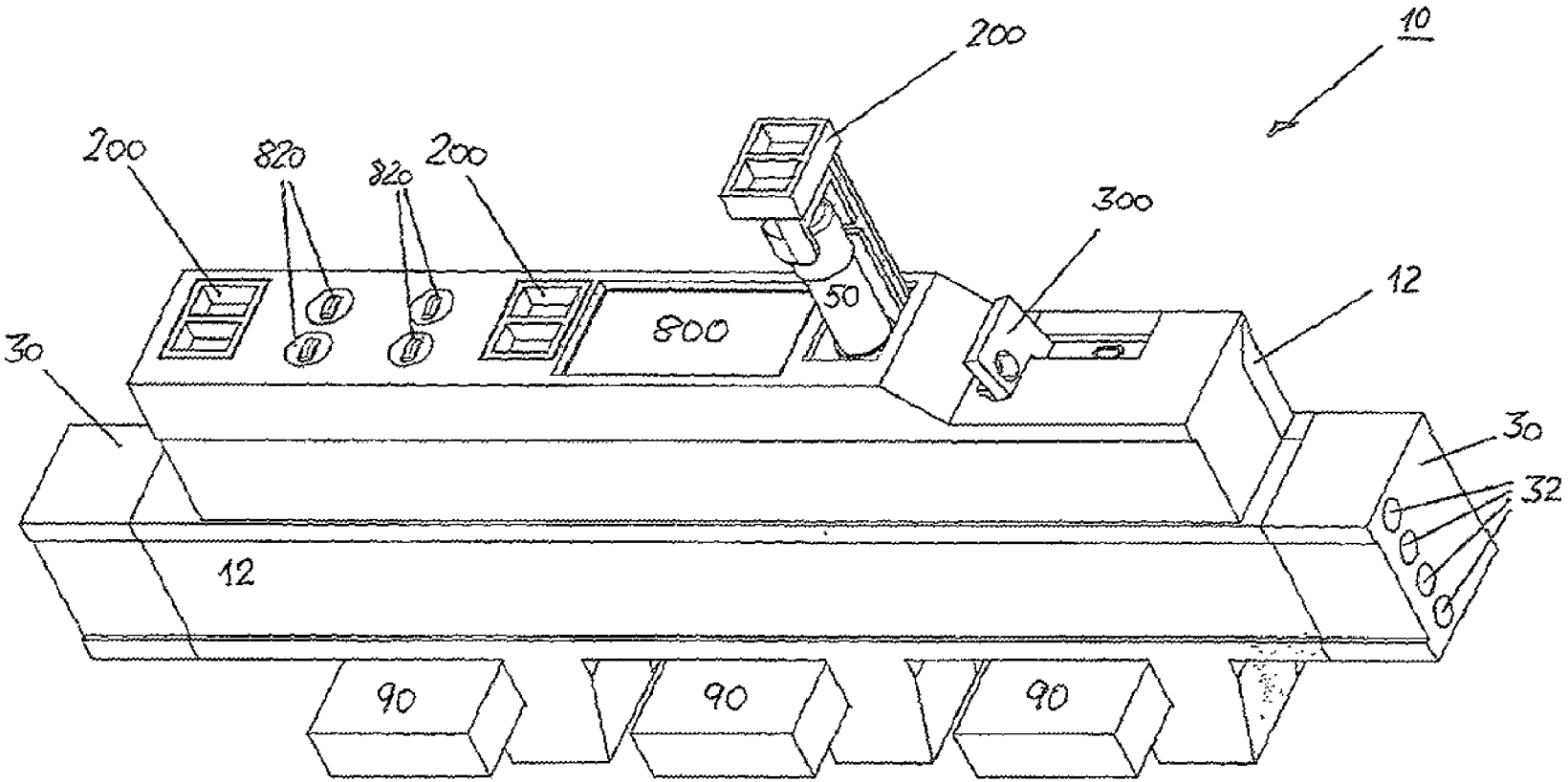
FIG. 1 shows a perspective view of a form of embodiment of an inventive fused switch arrangement.

FIG. 1 shows a perspective view of a form of embodiment of an inventive fused switch arrangement 10, wherein the said fused switch arrangement 10 takes the form of a 3-pole fused switch arrangement. The fused switch arrangement 10 is mounted on a busbar system with three busbars 90.

The fused switch arrangement 10 comprises a housing 12, wherein, in a longitudinal axis direction, which extends from left to right in FIG. 1, a terminal block 30 is provided at each end of the fused switch arrangement with terminals 32 for purposes of connecting contact cables.

The fused switch arrangement 10 comprises one fuse holder 200 per pole and per fused switch unit 100 (see, for example, FIG. 2); in this form of embodiment there are therefore three fuse holders 200.

The fuse holders 200 can be switched backwards and forwards between an operating position and a reception position, wherein two fuse holders 200, namely the fuse holders 200 that in FIG. 1 are located on the left and centrally, are located in their operating position, while the fuse holder 200 arranged on the right in FIG. 1 is located in its reception position.

As can be seen in FIG. 1, the fuse holder 200 is moved out of its operating position, in which it is located essentially completely within the housing 12 of the fused switch arrangement 10, upwards and essentially linearly in FIG. 1 into its reception position, such that a fuse 50 (often also designated as a fuse link) can be inserted into the fuse holder, and can be extracted from the latter.

The fused switch arrangement 10 comprises a switching lever 300, which is designed such that it can be switched backwards and forwards between a switched-on position and a switched-off position, wherein the switching lever 300 in FIG. 1 is located in its switched-off position.

The form of embodiment of a fused switch arrangement represented in FIG. 1 also comprises a display 800, in particular for purposes of displaying operating and functional data, together with operating buttons or operating elements 820 for purposes of controlling the fused switch arrangement.

Figure 2:
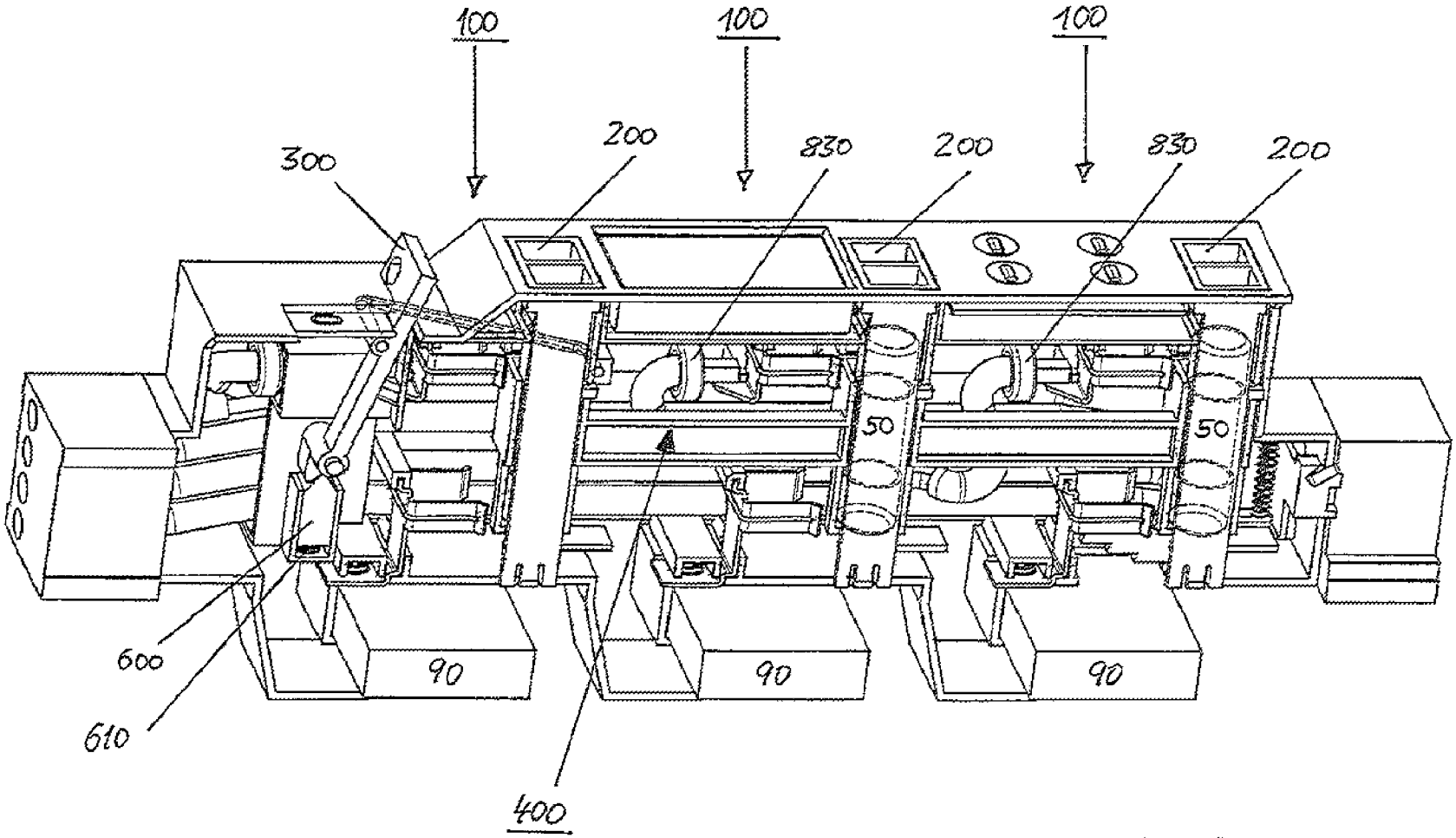
FIG. 2 shows a perspective view of an inventive fuse arrangement, in which some elements, in particular parts of the housing, have been removed, wherein the switching lever is located in its switched-off position.
Figure 3:
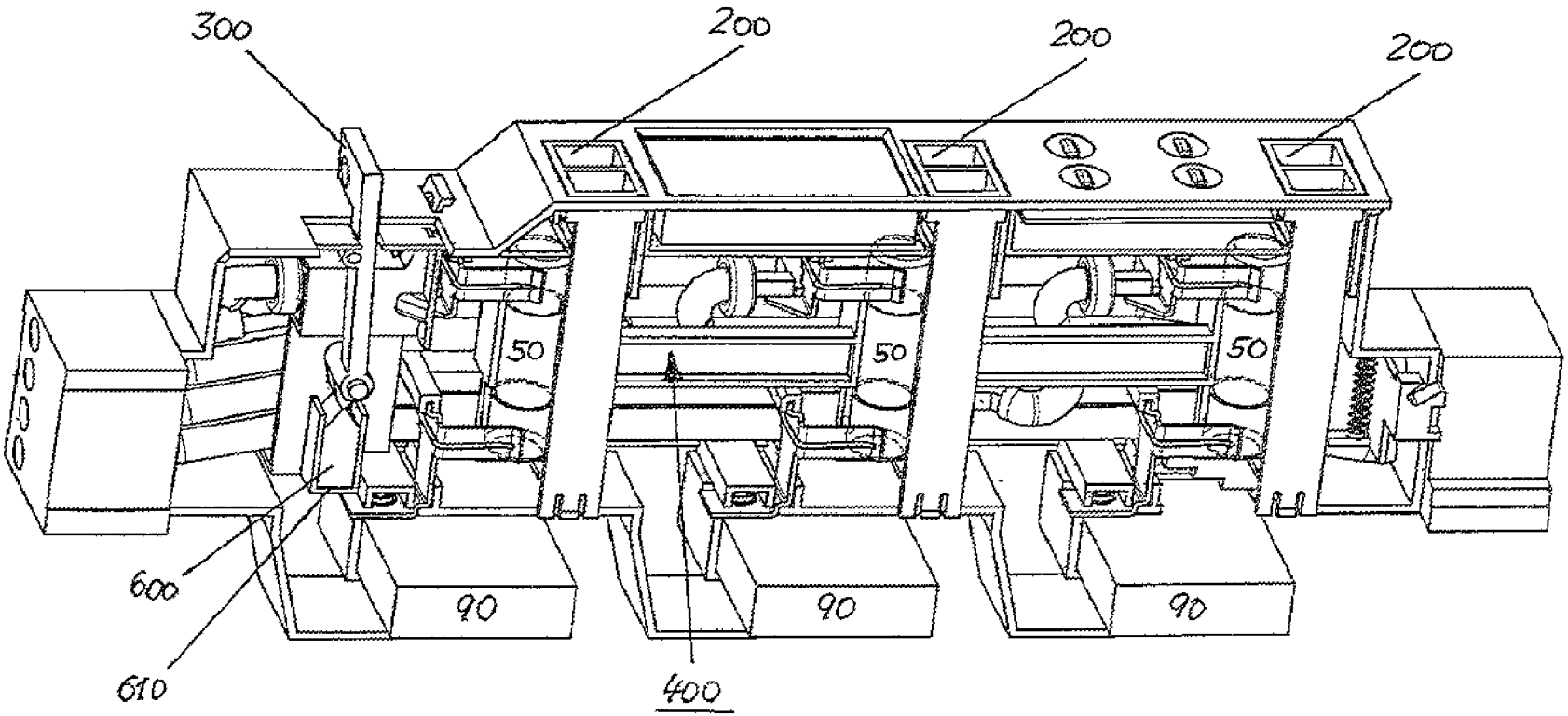
FIG. 3 shows a perspective view of an inventive fuse arrangement, in which some elements, in particular parts of the housing, have been removed, wherein the switching lever is located in a central position.
Figure 4:
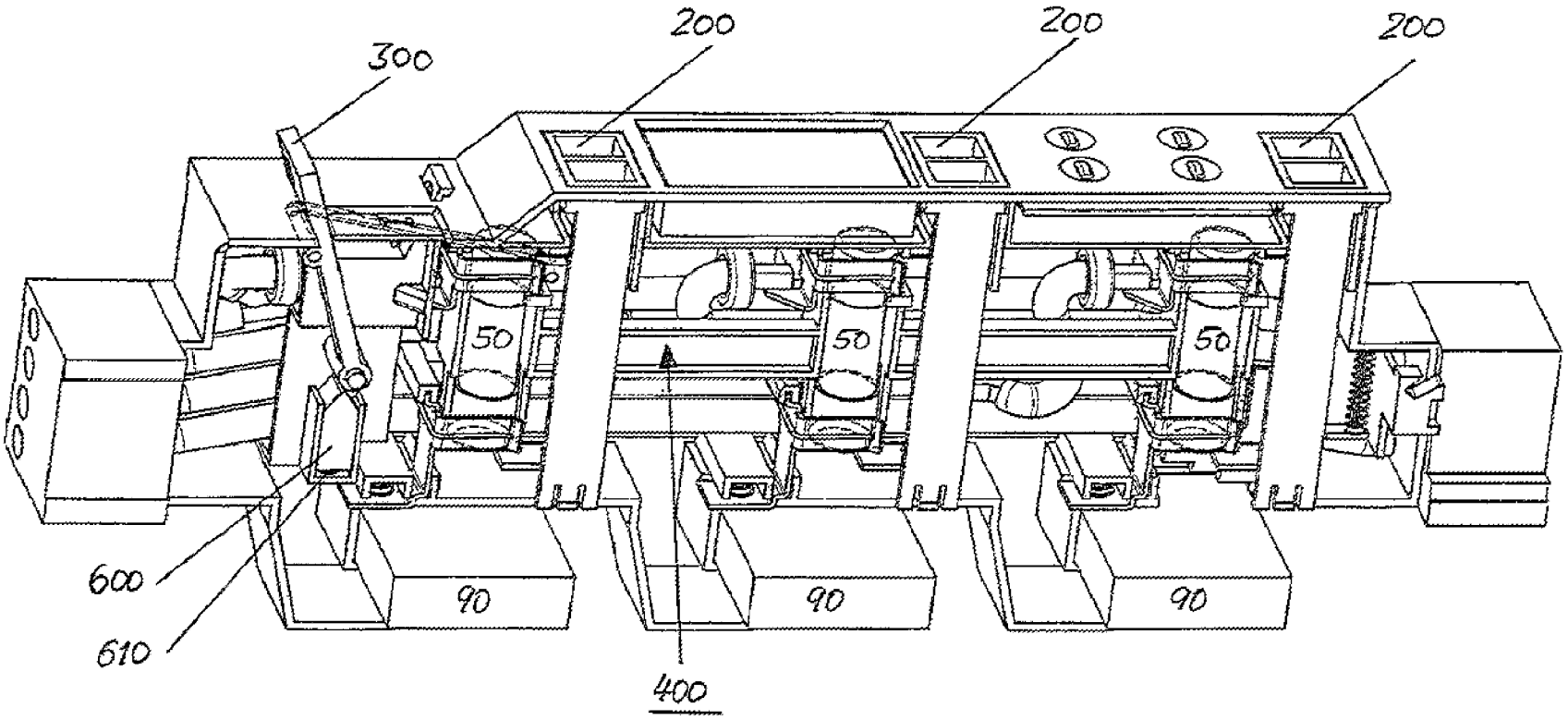
FIG. 4 shows a perspective view of an inventive fuse arrangement, in which some elements, in particular parts of the housing, have been removed, wherein the switching lever is located in its switched-on position.

FIGS. 2 to 4 show the fused switch arrangement shown in FIG. 1 in a partially sectioned state, such that some functional elements, which are located within the housing 12 of the fused switch arrangement 10, can be discerned.

FIG. 2 shows the fused switch arrangement 10, when the switching lever 300 is located in its switched-off position, FIG. 3 shows the fused switch arrangement 10 with the switching lever 300 in a central position, and FIG. 4 shows the fused switch arrangement 10 with the switching lever 300 in its switched-on position. The fuse holders 200 are located in their operating positions in all FIGS. 2 to 4, since otherwise it would not be possible to move the switching lever 300 out of its switched-off position into the switched-on position, as will be explained further in conjunction with the following figures.

In FIG. 2 the fuses 50 (represented by dashed lines) are located in their stand-by positions, that is to say, not in a contact position, and essentially within the fuse holder 200, namely exactly in a position relative to the fuse holder 200, as is represented in FIG. 1, except that all the fuse holders are located in their operating positions.

The form of embodiment shown in FIG. 2 also comprises electrical measuring coils 830, which preferably take the form of current-to-voltage converters, which serve to monitor the operating states of the fused switch arrangement. The corresponding measured data can, for example, be forwarded on to an integrated circuit for purposes of processing and/or for purposes of controlling the fused switch arrangement.

If the switching lever 300, as shown in FIGS. 3 and 4, is now moved out of its switched-off position via a central position (FIG. 3) into its switched-on position (FIG. 4), the fuses 50 are moved by the fuse driver unit 400 (which in FIG. 5 is illustrated once again in detail, see below) relative to the fuse holders from a stand-by position (FIG. 2) into a contact position (FIG. 4). Here the fuses 50 are at least partially, in the case of the form of embodiment shown here essentially completely, moved relative to and out of the fuse holders 200, without the fuse holders 200 themselves being moved.

As can also be easily seen in FIGS. 2 to 4, the fused switch arrangement is designed such that a force is applied to the switching lever via a cam element 600, which is pre-loaded by means of a spring device 610, such that the switching lever 300 is forced into its end positions, either into the switched-on position or into the switched-off position, so that it takes the form, as it were, of a bi-stable element.

FIG. 3 shows the switching lever 300 in a central position, that is to say, in a position in which the cam element 600 is pushed into its position of maximum compression against the spring force of the spring element 610.

If the switching lever 300 now moves out of its central position, for example, in the direction towards its switched-on position, the spring-loaded cam element acts so as to push the switching lever 300, independently of any further exertion of force by the user, automatically into its switched-on position.

By this means it is ensured, as has already been explained in the general description, that the switching process is executed essentially independently of the speed of operation and the force with which the user actuates the switching lever 300.

Figure 5:
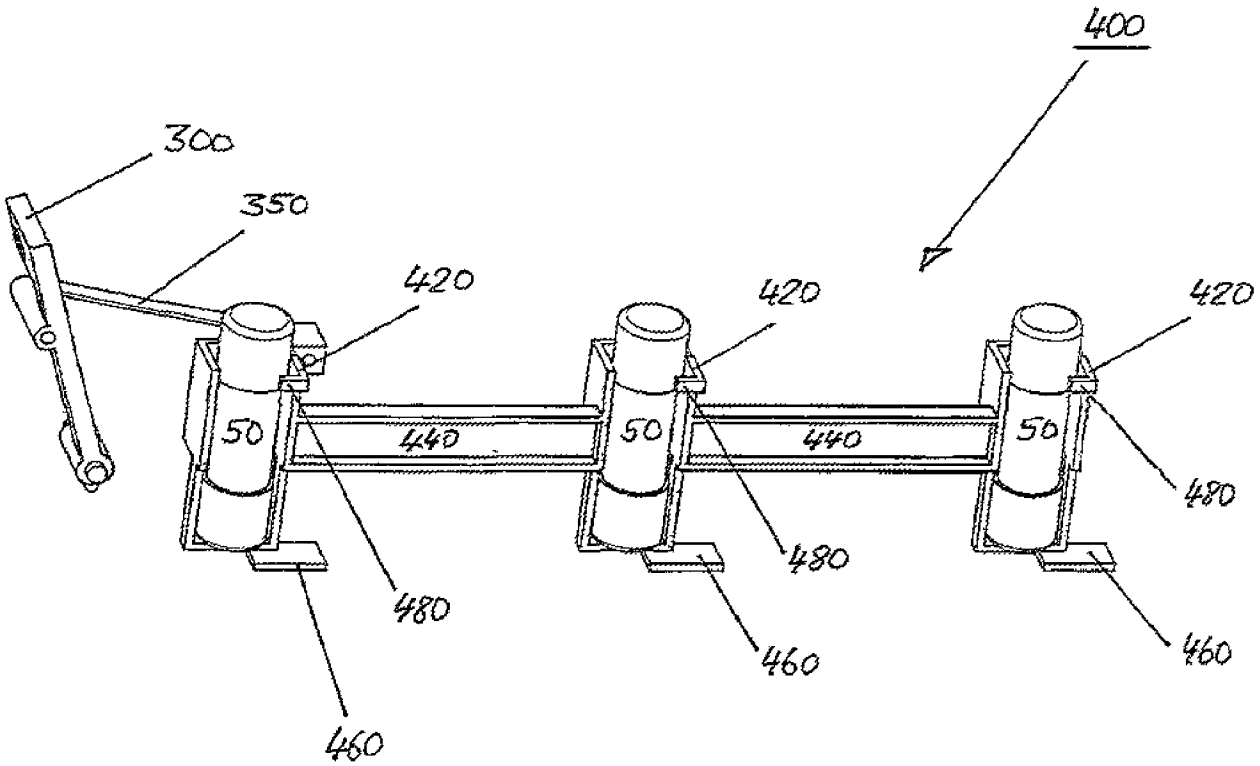
FIG. 5 shows a fuse driver unit and a switching lever coupled with the latter for a fused switch arrangement in accordance with the present invention.

FIG. 5 shows in a perspective view a form of embodiment of a fuse driver unit 400, coupled with the switching lever 300.

The fuse driver unit 400 comprises three fuse drivers 420, in each of which a fuse 50 is inserted. The fuse drivers 420 are connected with one another by means of a switching bar 440; in overall terms this form of embodiment of the fuse driver unit 400 takes the form of an integrally designed element.

The fuse driver unit 400 is coupled with the switching lever 300 by means of a transfer lever 350, such that the fuse driver unit 400 moves in the direction of the extent of the switching bar 440, that is to say, in FIG. 5 from left to right and vice versa, if the switching lever is switched backwards and forwards between its switched-on position and its switched-off position.

If, therefore, the switching lever 300 is switched from its switched-off position into its switched-on position, the fuse driver unit 400 slides the fuses 50, relative to the fuse holders 200 (not shown), into a contact position.

Figure 6:
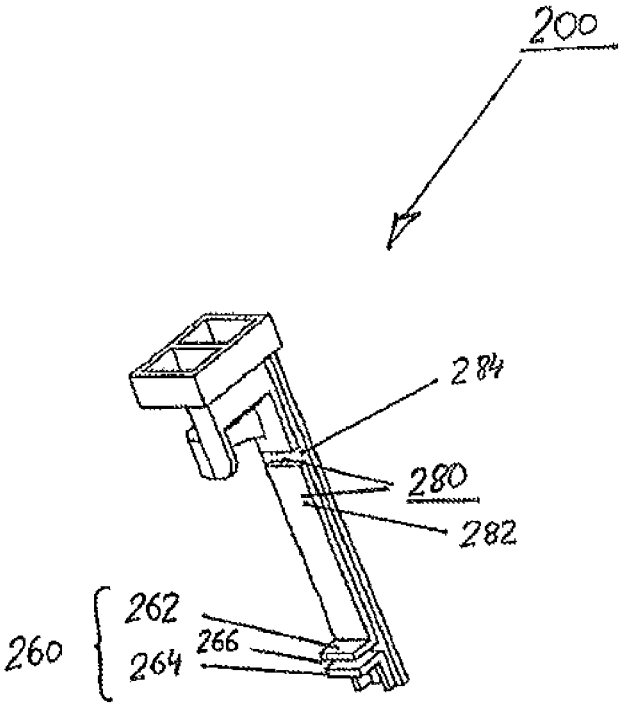
FIG. 6 shows a fuse holder of a fused switch arrangement in accordance with the present invention.

FIG. 6 shows in a perspective view a form of embodiment of a fuse holder 200, into which a fuse 50 can be inserted, as can be seen, for example, in FIG. 1.

As can be seen in FIG. 5, each fuse driver 420 of the fuse driver unit 400 comprises a first blocking element 480, designed as a nose, which interacts with a second blocking element 280 shown in FIG. 6, in this form of embodiment designed with a guide groove 284, such that the first blocking element impacts against the second blocking element and prevents the fuse driver unit from switching from its reception position into its operating position if a fuse holder is not located in its operating position, since in this case the first blocking element 480, designed as a nose, does not align with the groove 284 of the second blocking element 280, but instead impacts against a stop 282.

Each fuse driver 420 of the fuse driver unit 400 furthermore comprises a third blocking element 460, which in this form of embodiment is designed as a projection, or as a plate, while the fuse holder 200 comprises a fourth blocking element 260, which comprises two projections 262, 264, which are arranged spaced apart from one another such that a guide groove 266 is formed between them. Here the third blocking element 460 and the fourth blocking element 260 are designed in a shape in which they interact with one another such that the third blocking element impacts against the fourth blocking element and prevents the fuse holder from switching from its operating position into its reception position, if the switching lever is located in its switched-on position.

Figure 8:
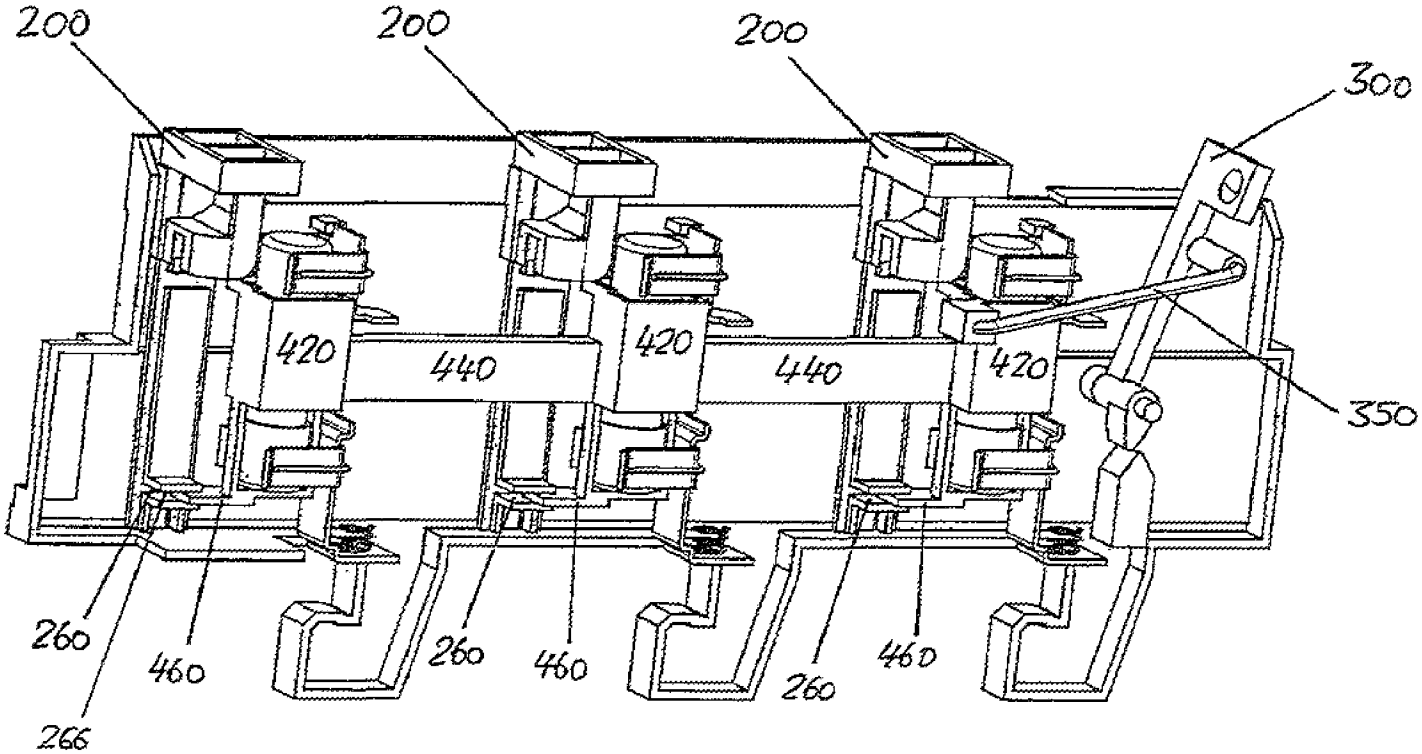
FIG. 8 shows a perspective view of an inventive fuse arrangement, in which some elements, in particular parts of the housing, have been removed, wherein the fused switch is located in its switched-on position.

This situation is represented in FIG. 8, in which it is very easy to see that the third blocking element 460 designed as a plate, engages in the groove 266 of the fourth blocking element 260 such that the fuse holder 200 cannot be pushed out of its operating position into a reception position; in FIG. 8, that is to say, it cannot be pushed upwards.

Figure 7:
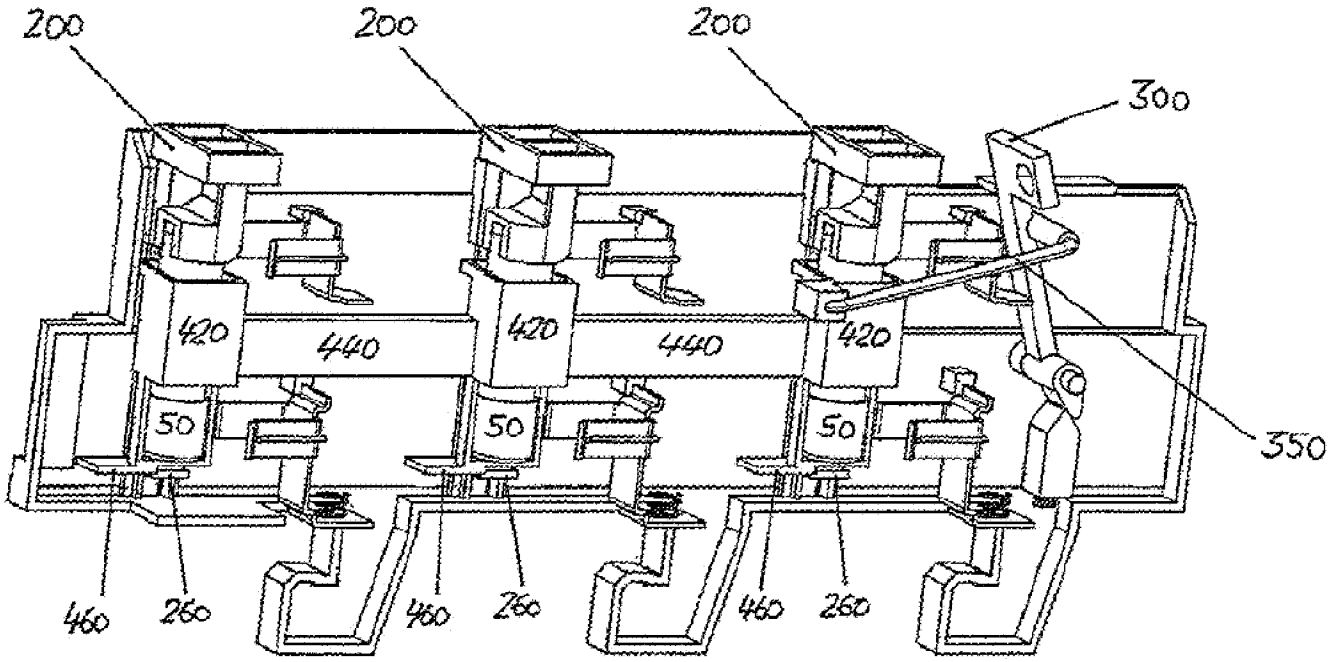
FIG. 7 shows a perspective view of an inventive fuse arrangement, in which some elements, in particular parts of the housing, have been removed, wherein the fused switch is located in its switched-off position.

FIG. 7 shows a similar representation to that in FIG. 8, but now the switching lever 300 is located in its switched-off position, and FIG. 7 shows clearly that the third blocking element 460 and the second blocking element 260 are not in engagement with one another, so that it is possible to switch the fuse holder 200 out of the operating position, as is shown in FIG. 7, into the reception position, that is to say, in FIG. 7, to push it upwards.

Figure 9:
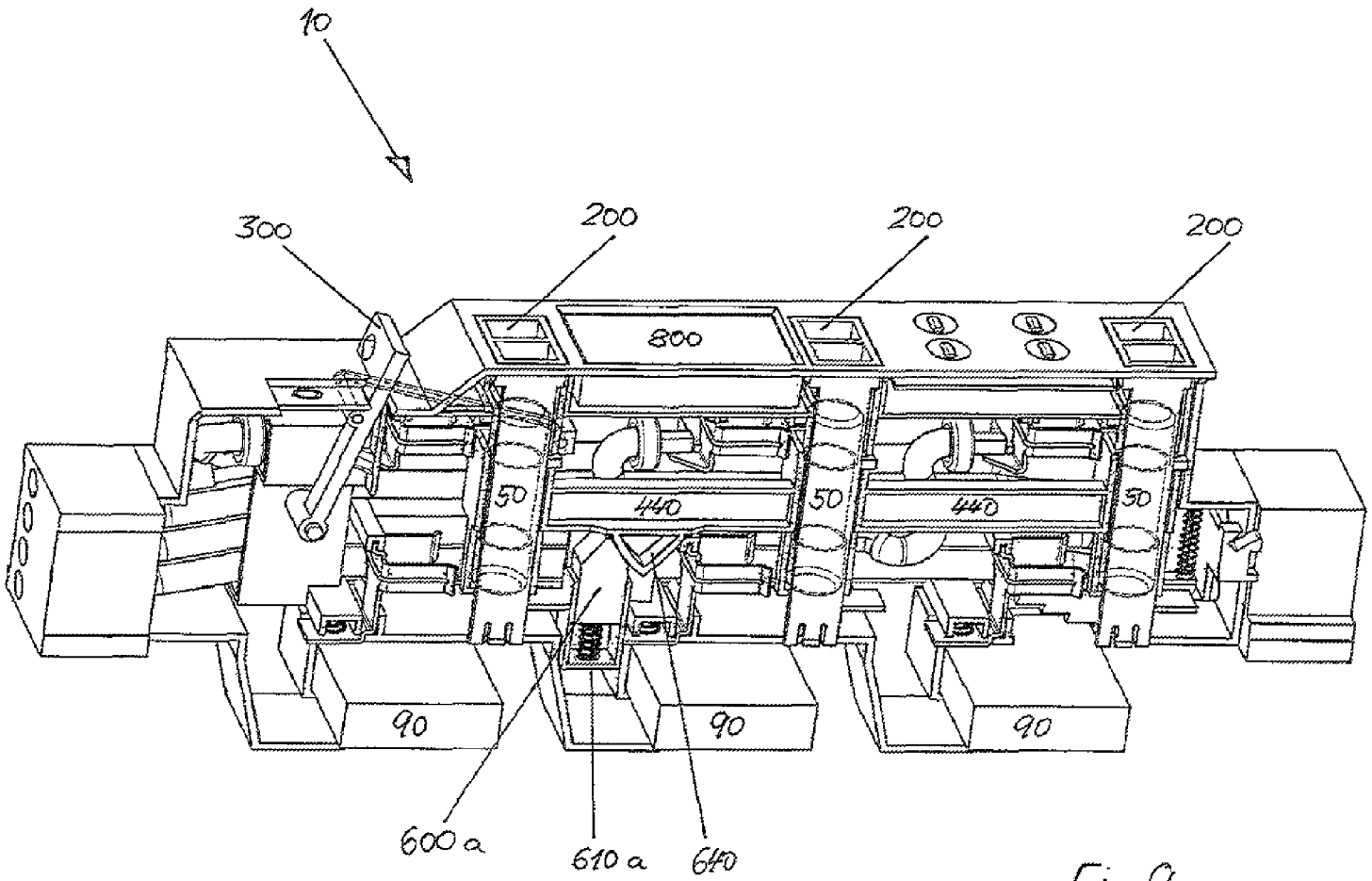
FIG. 9 shows a perspective view of an further form of embodiment of the inventive fuse arrangement, in which some elements, in particular parts of the housing, have been removed, wherein the fused switch is located in its switched-off position.

FIG. 9 shows a further form of embodiment of an inventive fused switch arrangement, which essentially corresponds with the form of embodiment of the fused switch arrangement that has been described in FIGS. 1 to 8.

In contrast to the first form of embodiment, however, this fused switch arrangement 10 comprises another cam element **600*a*, to which a force is similarly applied by a spring device 610*a***.

In principle the mode of operation of the alternative cam element **600*a*, in conjunction with the spring device 610*a*, is identical to that in the form of embodiment that has been described in FIGS. 1 to 8, but the cam element 600*a* does not act on the switching lever 300, but on a counter-element 640, which is designed to be essentially triangular in shape and is arranged on the fuse driver unit 400, in this form of embodiment on a switching bar 440**.

In other respects, with regard to the mode of operation of the further form of embodiment of the fused switch arrangement 10, as has been described in FIG. 9, reference is made to the above description.

The features disclosed in the above description, in the claims, and in the figures, can be of importance, both individually and also in any combination, for the implementation of the invention in its various configurations.

What is claimed is:

1. A multi-pole fused switch arrangement for busbar systems, with at least two fused switch units, each of which can accommodate one fuse, and with a contact device for busbars, wherein the fuse switch arrangement furthermore comprises the following:

in each case a fuse holder for the accommodation of one fuse for each fused switch unit, wherein the fuse holder is configured to be switched backwards and forwards between a fuse holder reception position and a fuse holder operating position, and wherein the fuse holder is configured such that the one fuse can be inserted into the fuse holder, if the fuse holder is located in its fuse holder reception position, a fuse driver unit, which in each case comprises a fuse driver for each fused switch unit, wherein the fuse driver unit is configured to be switched backwards and forwards between a fuse driver unit reception position and a fuse driver unit operating position, a switching lever, which is configured to be switched backwards and forwards between a switched-on position and a switched-off position, wherein the switching lever is coupled with the fuse driver unit such that the fuse driver unit is located in its fuse driver unit reception position if the switching lever is located in its switched-off position, and such that the fuse driver unit is located in its fuse driver unit operating position if the switching lever is located in its switched-on position, wherein the fuse driver unit is coupled with the switching lever such that the fuse driver and ones of said fuses, which are inserted in the fuse holder, which is located in its fuse holder operating position, move relative to the use holder from a stand-by position into a contact position, if the switching lever is switched from its switched-off position into its switched-on position with said fuse holder retained in said fuse holder operating position by mechanical fastening to the multi-pole fused switch arrangement, said fuse driver unit moves said ones of said fuses into the contact position, while said fuse holder is not moved.

2. The multi-pole fused switch arrangement according to claim 1, wherein the switching lever can only be moved from its switched-off position into its switched-on position if all the fuse holders are located in their fuse holder operating positions.

3. The multi-pole fused switch arrangement according to claim 2, wherein each fuse driver comprises a first blocking element, and each fuse holder comprises a second blocking element, which interact with one another such that the first blocking element impacts against a part of the second blocking element, and prevents the fuse driver unit from switching from its fuse driver unit reception position into its fuse driver unit operating position, if a fuse holder is not located in its fuse holder operating position.

4. The multi-pole fused switch arrangement according to claim 3, wherein the first blocking element comprises one of a nose or a projection, while the second blocking element comprises a stop and a guide, wherein the first and the second blocking elements are designed and arranged such that the one of a nose or a projection of the first blocking element can only be introduced into the guide of the second blocking element if the fuse holder is located in its fuse holder operating position.

5. The multi-pole fused switch arrangement according to claim 1, wherein the fused switch arrangement is configured such that the fuse holder can only be switched from its fuse holder operating position into its fuse holder reception position if the switching lever is located in its switched-off position.

6. The multi-pole fused switch arrangement according to claim 5, wherein each fuse driver comprises a third blocking element and each fuse holder comprises a fourth blocking element, which interact with one another such that the third blocking element strikes against a part of the fourth blocking element, and prevents the fuse holder front switching from its fuse holder operating position into its fuse holder reception position, if the switching lever is located in its switched-on position.

7. The multi-pole fused switch arrangement according to claim 6, wherein the third blocking element comprises one of a nose or a projection, while the fourth blocking element forms a stop and a guide, wherein the third and fourth blocking elements are configured such that the one of a nose or a projection of the third blocking element can only be introduced into the guide of the fourth blocking element if the fuse holder is located in its fuse holder operating position.

8. The multi-pole fused switch arrangement according to claim 1, further comprising a spring device for applying one of a direct force and an indirect force to the switching lever such that the switching lever is pre-loaded both into its switched-on position, and also into its switched-off position.

9. The multi-pole fused switch arrangement according to claim 8, further comprising a cam element, to which a force is applied by the spring device, and which interacts one of directly and indirectly with a part of the switching lever.

10. The multi-pole fused switch arrangement according to claim 8, further comprising a cam element, to which a force is applied by the spring device, and which interacts one of directly and indirectly with a part of the fuse driver unit.

11. The multi-pole fused switch arrangement according to claim 1, wherein the fuse driver unit is one piece, wherein the fuse drivers are connected with one another by at least one switching bar.

12. The multi-pole fused switch arrangement according to claim 1, wherein the switching lever is coupled with the fuse driver unit by at least one transfer lever.

13. The multi-pole fused switch arrangement according to claim 12, wherein the at least one transfer lever is attached to the fuse driver that is located closest to the switching lever.

14. The multi-pole fused switch arrangement according to according to claim 1, wherein the fuse holders are configured to lock into their operating position.

15. The multi-pole fused switch arrangement according to according to claim 1, wherein the fuse holders are arranged one behind another generally along a longitudinal axis, and wherein the multi-pole fused switch arrangement is defined at each end by a terminal block for connecting contact cables.

16. A multi-pole fused switch arrangement for busbar systems, with at least two fused switch units, each of which can accommodate one fuse, and with a contact device for busbars, wherein the fuse switch arrangement furthermore comprises the following:

In each case a fuse holder for the accommodation of one fuse for each fused switch unit, wherein the fuse holder is configured to be switched backwards and forwards between a fuse holder reception position and a fuse holder operating position, and wherein the fuse holder is configured such that the one fuse can be inserted into the fuse holder, if the fuse holder is located in its fuse holder reception position, a fuse driver unit, which in each case comprises a fuse driver for each fused switch unit, wherein the fuse driver unit is configured to be switched backwards and forwards between a fuse driver unit reception position and a fuse driver unit operating position, a switching lever, which is configured to be switched backwards and forwards between a switched-on position and a switched-off position, wherein the switching lever is coupled with the fuse driver unit such that the fuse driver unit is located in its fuse driver unit reception position if the switching lever is located in its switched-off position, and such that the fuse driver unit is located in its fuse driver unit operating position if the switching lever is located in its switched-on position, wherein the fuse driver unit is coupled with the switching lever such that the fuse driver and ones of said fuses, which are inserted in the fuse holder, which is located in its fuse holder operating position, move relative to the fuse holder from a stand-by position into a contact position, if the switching lever is switched from its switched-off position into its switched-on position with said fuse holder retained to the multi-pole fused switch arrangement in said fuse holder operating position by a snap-fit connection, so that said fuse driver unit moves said ones of said fuses into the contact position, while said fuse holder is not moved.

* * * * *